US005918368A

United States Patent [19]

Ervin et al.

[11] Patent Number: 5,918,368

[45] Date of Patent: Jul. 6, 1999

[54] METHOD FOR MAKING A RECUPERATOR CELL

[75] Inventors: Doug R. Ervin; Tom L. Grigsby, both of Morton; Robert A. Prochnow, El Paso, all of Ill.

[73] Assignee: Solar Turbines, Inc., San Diego, Calif.

[21] Appl. No.: 08/921,731

[22] Filed: Aug. 27, 1997

[51] Int. Cl.[6] ..... B23P 15/26

[52] U.S. Cl. ..... 29/890.03; 29/890.034

[58] Field of Search ..... 29/890.03, 890.04, 29/428

[56] References Cited

U.S. PATENT DOCUMENTS

| | | | |
|---|---|---|---|
| 2,558,752 | 7/1951 | Holm | 29/890.034 |
| 3,285,326 | 11/1966 | Wosika | 165/166 |
| 3,476,174 | 11/1969 | Guernsey et al. | 29/890.034 |
| 3,507,115 | 4/1970 | Wisoka | 165/166 |
| 3,759,323 | 9/1973 | Dawson et al. | 165/166 |
| 3,785,435 | 1/1974 | Stein et al. | 165/76 |
| 4,405,011 | 9/1983 | Stockman | 29/890.034 |
| 5,119,885 | 6/1992 | Johnson | 29/890.034 |

*Primary Examiner*—Irene Cuda
*Attorney, Agent, or Firm*—Larry G. Cain

[57] ABSTRACT

Circular recuperators are used to increase the efficiency of gas turbine engines. The present circular recuperators is made of a plurality of cells. Each of the plurality of cells includes a plurality of components, such as, a plurality of sheets, a plurality of bars and guide strips. To more efficiently utilize the configuration of a primary surface circular heat exchanger or recuperator, the plurality of cells are manufactured to have a involute configuration. A fixture is used to position, hold and form the involute configuration. The fixture includes clamping device which positions and holds a base edge and the plurality of bars in a preestablished position and a forming member forms the remainder of the individual cells into the involute configuration. Corresponding ones of the base edges of individual cells form an inner diameter of the recuperator.

8 Claims, 6 Drawing Sheets

METHOD FOR MAKING A RECUPERATOR CELL

TECHNICAL FIELD

This invention relates generally to a circular primary surface heat exchanger and more particularly to an apparatus and method of making a plurality of cell used to form the circular primary surface heat exchanger.

BACKGROUND ART

Many gas turbine engines use a heat exchanger of recuperator to increase the operation efficiency of the engine by extracting heat from the exhaust gas and preheating the intake air. Typically, a recuperator for a gas turbine engine must be capable of operating at temperatures of between about 500 degrees C. and 700 degrees C. and internal pressures of between approximately 450 kPa and 1400 kPa under operating conditions involving repeated starting and stopping cycles.

Such circular recuperators include a core which is commonly constructed of a plurality of relatively thin flat sheets having an angled or corrugated spacer fixedly attached therebetween. The sheets are joined into cells and sealed at opposite sides and form passages between the sheets. These cells are stacked or rolled and form alternative air cells and hot exhaust cells. Compressed discharged air from a compressor of the engine passes through the air cell while hot exhaust gas flows through alternate cells. The exhaust gas heats the sheets and the spaces, and the compressor discharged air is heated by conduction from the sheets and spacers.

An example of such a recuperator is disclosed in U.S. Pat. No. 5,060,721 issued to Charles T. Darragh on Oct. 29, 1991. In such a system, a heat exchanger having been used to increase the efficiency of engine by absorbing heat from the exhaust gases and transferring a portion of the exhaust heat to the intake air is disclosed. The heat exchanger is built-up from a plurality of performed involute curved cells stacked in a circular array to provide flow passages and for the donor fluid and the recipient fluid respectively.

The construction of such cells when having each of the components formed prior to assembly increases cost, time and complexity of the assembly process. Additionally, the variation of tolerance between individual sheets or components increases assembly cost, time and complexity.

The present invention is directed to overcoming one or more of the problems as set forth above.

DISCLOSURE OF THE INVENTION

In one aspect of the invention a method of making a cell for use with a circular recuperator is defined. The method of making including the following steps: attaching a bar to a first sheet; attaching a bar to a second sheet; positioning a base edge of the first sheet in contacting relationship with an abutting wall of a first fixture; positioning a base edge of the second sheet in contacting relationship with an abutting wall of a second fixture; moving one of the first fixture and the second fixtures into a closed position abutting the bar and the first sheet with the bar and the second sheet; moving a third fixture into a closed position abutting the remainder of the first sheet with the second sheet; and securing the first sheet and the second sheet in abutting relationship.

BEST MODE FOR CARRYING OUT THE INVENTION

Figure 1:
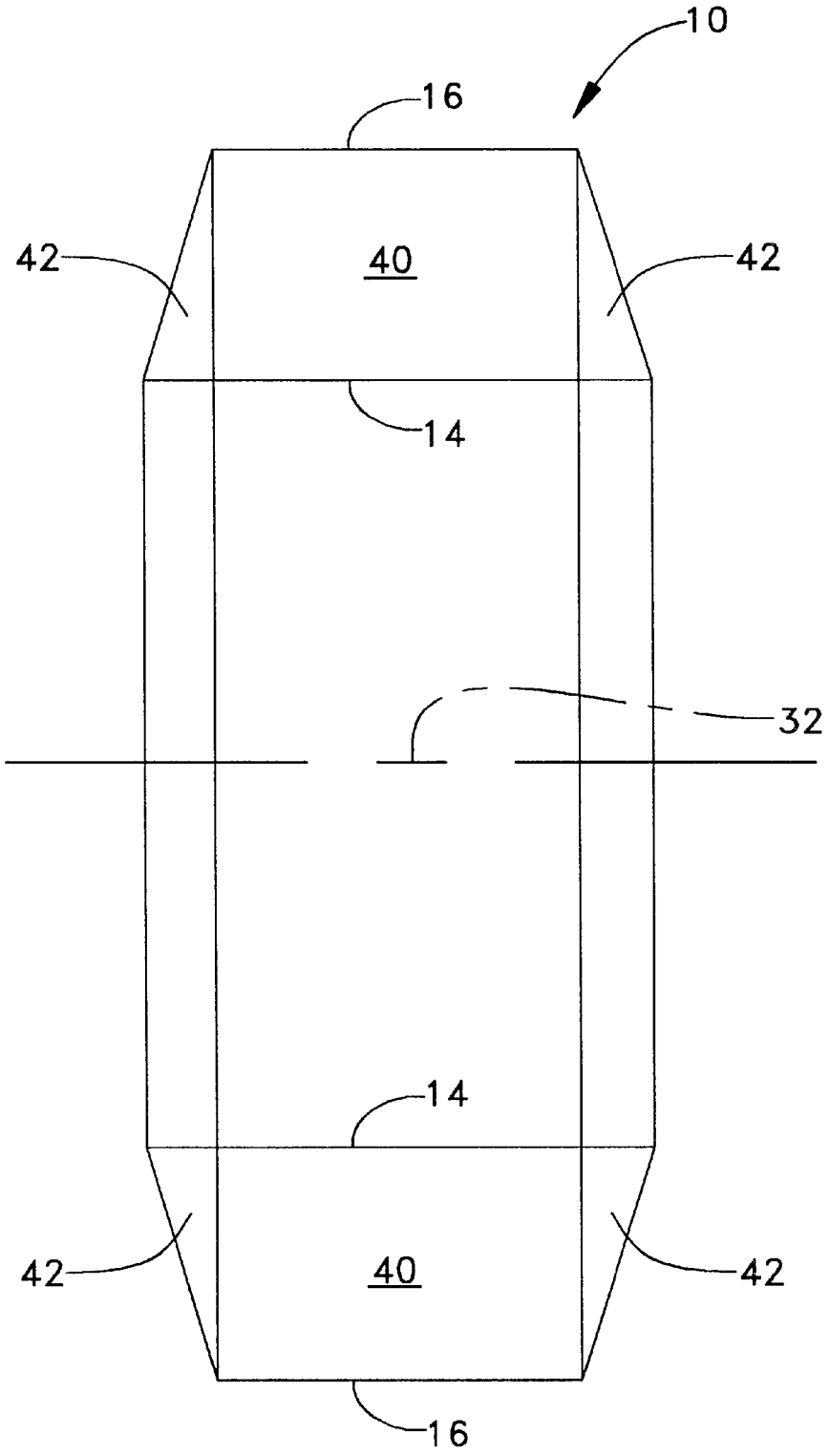
FIG. 1 is a sectional view of a heat exchanger of recuperator embodying the present invention.
Figure 2:
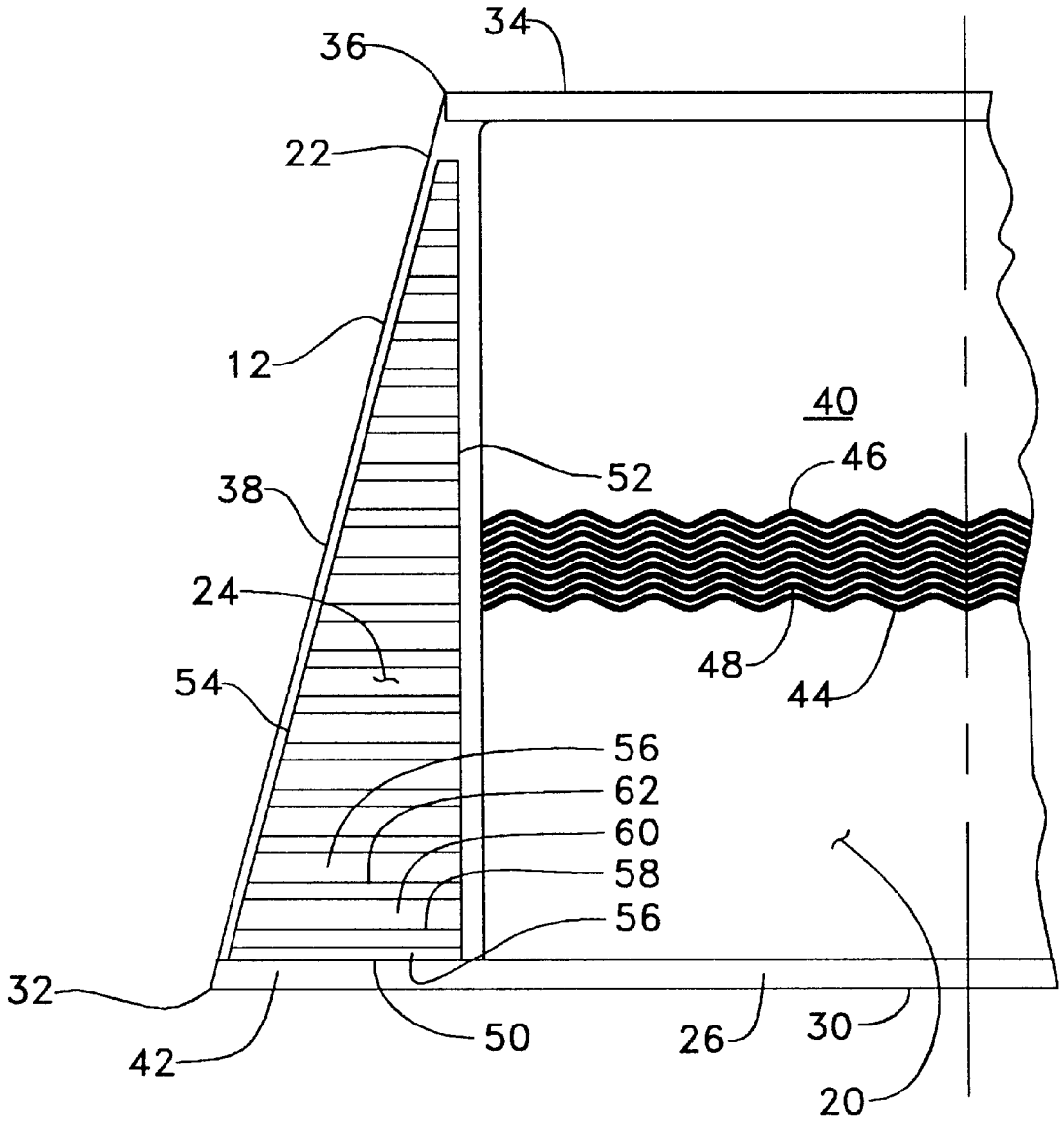
FIG. 2 is an enlarged cross-sectional view of the involute configuration of a recipient cell.
Figure 3:
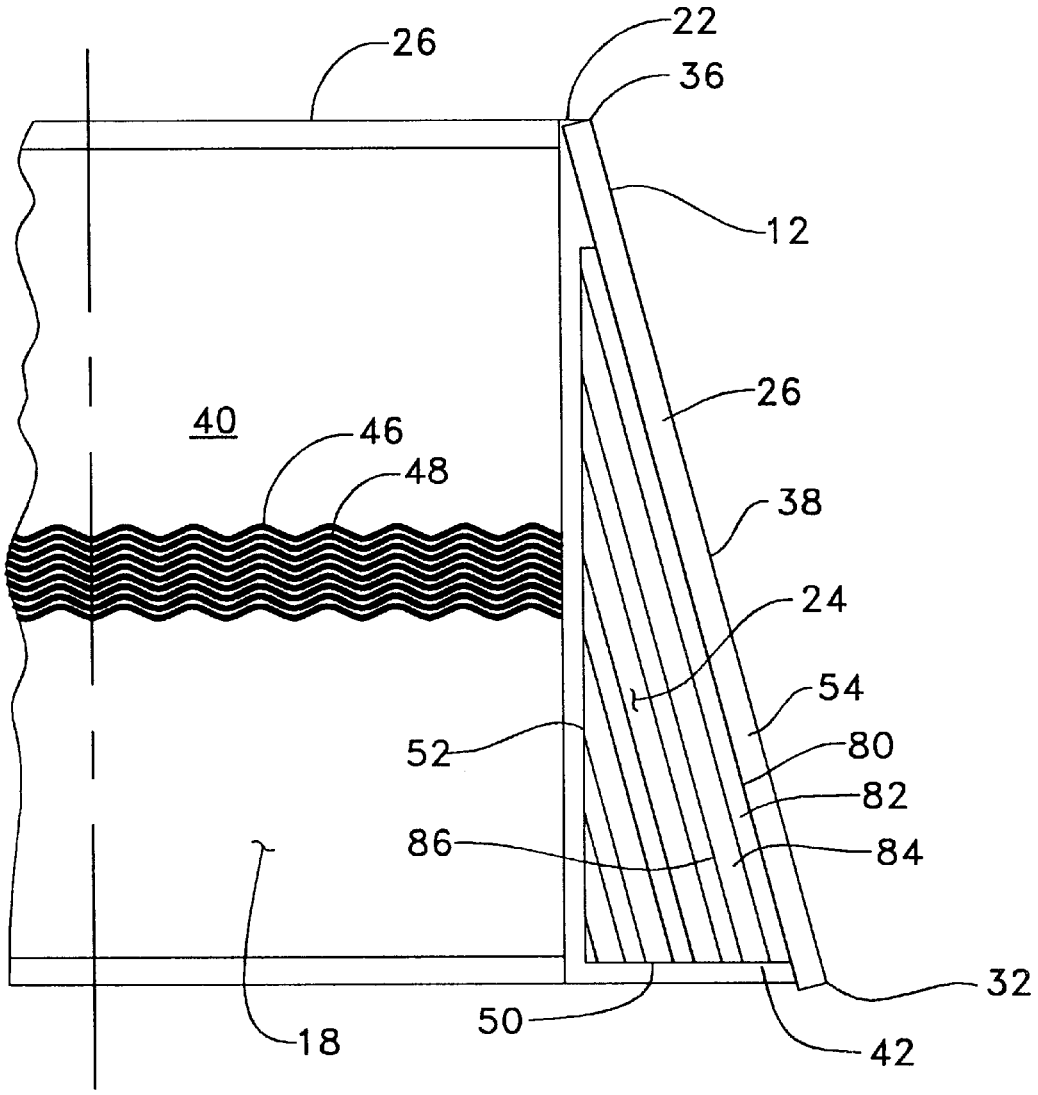
FIG. 3 is an enlarged cross-sectional view of the involute configuration of a donor cell.

Referring to FIGS. 1, 2 and 3, a heat exchanger or recuperator 10 includes a plurality of individual cells 12 fixedly attached to form the circular recuperator 10 which is defined by an inner diameter 14 and an outer diameter 16. The plurality of cells 12 are formed as either a donor cell 18 or a recipient cell 20 and are alternately positioned within the circular recuperator 10. Each of the plurality of individual cells 12 is formed of a pair of primary surface sheets 22, a pair guide strips 24 and a plurality of bars 26.

In this application, the pair of primary surface sheets 22 are generally identical in configuration for the donor cells 18 and the recipient cells 20. Each of the pair of primary surface sheets 22 includes a base edge 30 having a preestablished length defining a pair of ends 32. The base edge 30, which when in the assembled form, corresponds to the inner diameter 14 of the circular recuperator 10. An outer edge 34 is spaced from the base edge 30. The outer edge 34 is defined on each of the pair of primary surface sheets 22, has a preestablished length and defines a pair of ends 36 positioned opposite the base edge 30. In this application, the outer edge 34 is generally parallel with the base edge 30 and has the preestablished length being less than the preestablished length of the base edge 30. Extending between the base edge 30 and the outer edge 34 and connecting corresponding ones of the pair of ends 32,36 are a pair of extension edges 38. Each of the pair of primary surface sheets 22 include a center portion 40 extending between the base edge 30 and the outer edge 34. Interposed the center portion 40 and each of the pair of extension edges 38 is a wing portion 42. In this application, the center portion 40 has a generally rectangular configuration and the wing portions 42 has a generally triangular configuration. The center portion 40 includes a plurality of pleats 44 defining a peak 46 and a valley 48 and the wing portions 42 are flat or have been flattened.

Additionally, the pair of guide strips 24 for each of the donor cells 18 and the recipient cells 20 have a distinct geometric configuration which, in this application, is of a different configuration or construction. For example, in this application, the guide strip 24 used in conjunction with the donor cells 18 and the recipient cells 20 have a generally common triangular configuration defining a base 50, a height 52 and a hypotenuse 54. The guide strips 24 for the recipient cells 20 when viewed through a cross-section thereof defines an axial portion 56 extending from the base 50, a first extension member 58 extending from the axial portion 56, a top portion 60 extending axially from the extension member 58 and being generally parallel with the axial portion 56 and a second extension member 62 extending from the top portion 60 toward a second repletion of the axial portion 56 etc. However, the guide strips 24 for the donor cells 18 when viewed through a cross-section thereof defines an axial portion 80 extending from the hypotenuse 54, a first extension member 82 extending from the axial portion 80, a top portion 84 extending axially from the first extension member 82 and being generally parallel with the axial portion 80 and a second extension 86 extending from the top portion 84 toward a second repletion of the axial portion 80 etc.

Figure 4:
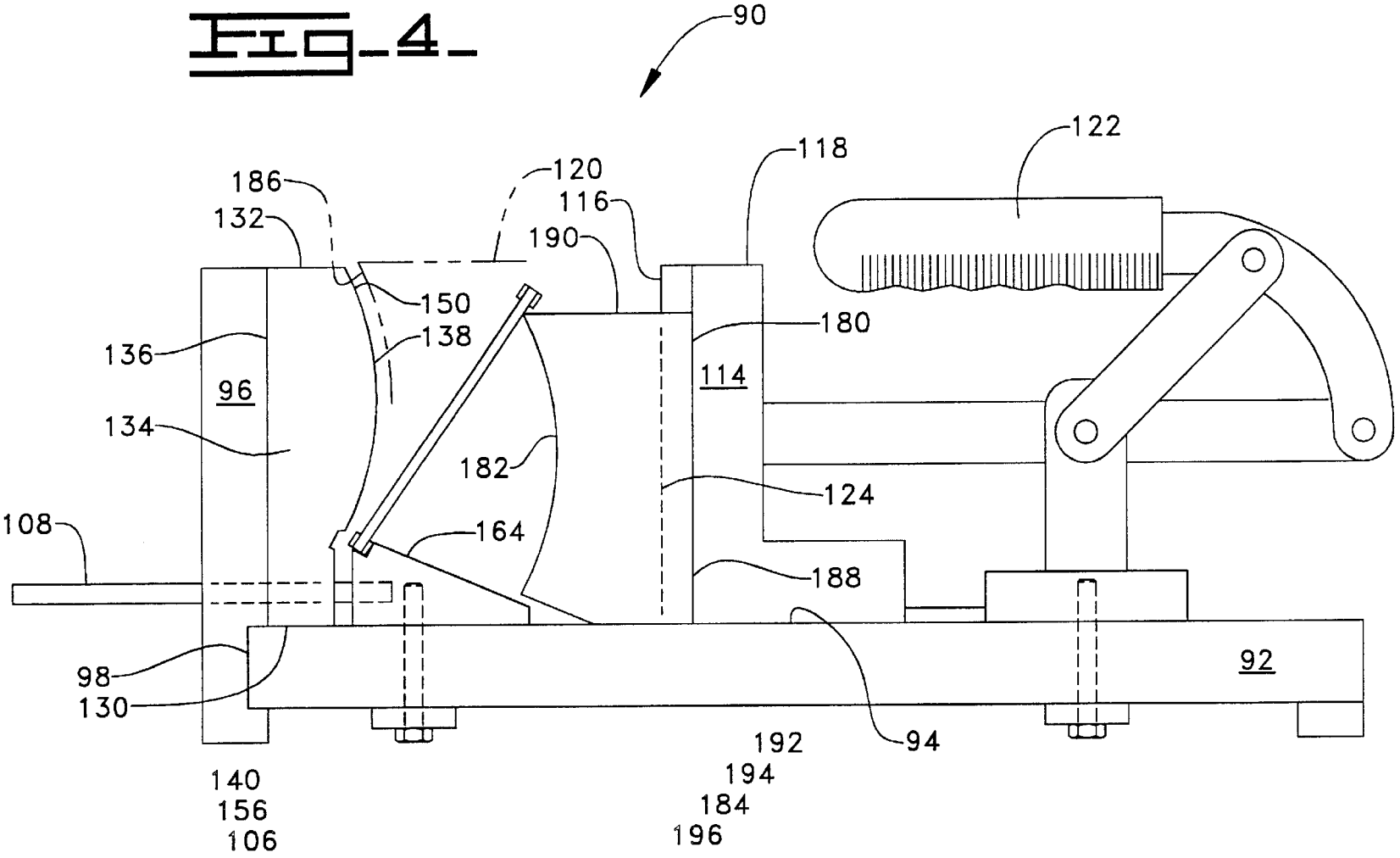
FIG. 4 is a side view of a fixture used to manufacture the cell.
Figure 5:
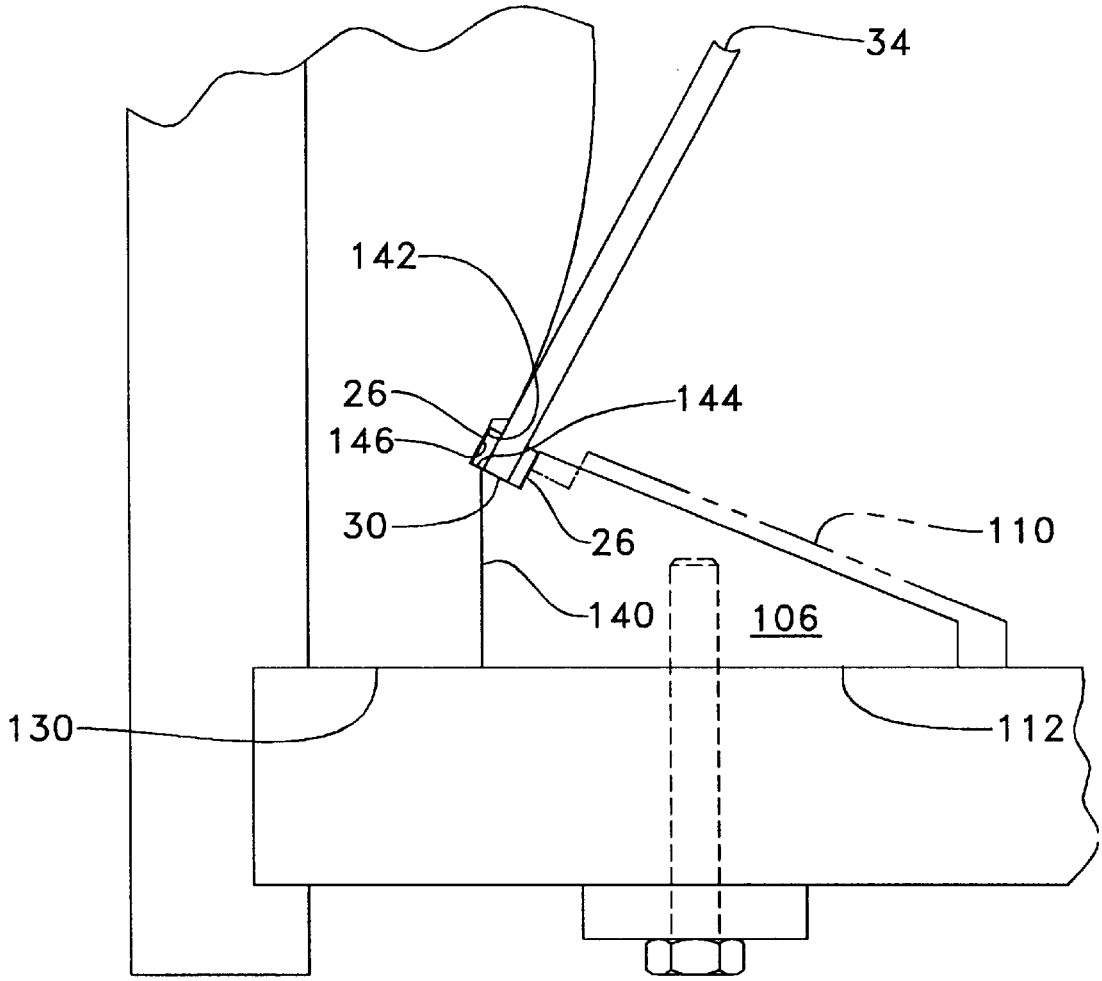
FIG. 5 is an enlarged view taken within the line 5 of FIG. 4.
Figure 6:
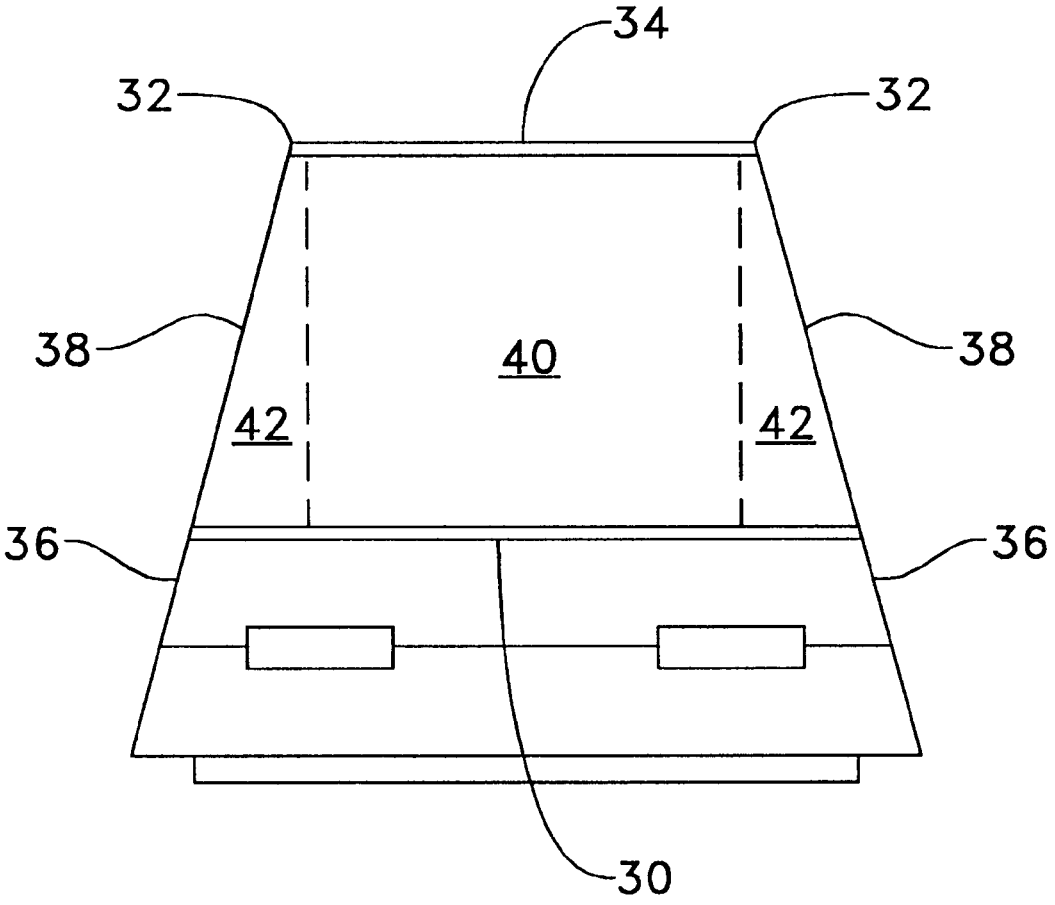
FIG. 6 is an end view of the fixture taken along line 6—6 of FIG.4.

To form the donor cells 18 and the recipient cells 20, a fixture 90 is used. The fixture, as best shown in FIGS. 4, 5, and 6, includes a base 92 defining a sliding surface 94 and has an abutting end member 96 attached thereto at an end 98. Removably attached to the end member 96 is a male forming block 100. Attached to the sliding surface 94 of the base 92 is a clamping device or fixture 106. A first force applying device 108 slidably moves the clamping device 106 between an open position 110 and a closed or clamped position 112. Further attached to the sliding surface 94 is a forming member 114 defining a mounting surface 116. The forming member 114 is slidably movable between an open position 118 and a closed or clamped position 120 by a second force applying device 122. A female forming block 124 is movably attached to the mounting surface 116 of the forming member 114.

The male forming block or fixture 100 defines a first end 130 being positioned adjacent the sliding surface 94 of the base 92 and a second end 132 is positioned opposite the first end 130. A pair of sides 134 extend between the first and second ends 130,132 respectively. A mounting surface 136 being in contacting relationship with the end member 96 is defined by the first and second ends 130,132 and the pair of sides 134. A forming surface 138 having an irregular shape is spaced from the mounting surface 136 and is defined by the first and second ends 130,132 and the pair of sides 134. The first end 130 is positioned adjacent the sliding surface 94 of the base 92. The irregular shape of the forming surface 138 is defined by a vertical surface 140 extending upwardly a predetermined distance away from the sliding surface 94 and the first end 130. Extending from the vertical surface 140 generally toward the mounting surface 136 is a recess 142. As best shown in FIG. 5, the recess 142 extends the entire length between the pair of sides 134 and is defined by a first side wall 144 extending from the vertical surface 140 toward the mounting surface 136 at an obtuse angle to the first end 130. An abutting wall 146 extends from the first side wall 144 at and acute angle to the first end 130 and a second side wall 148 extends from the abutting wall 146 away from the mounting surface 136 at an obtuse angle to the first end 130. The remainder of the irregular shape is defined by a preestablished involute shape 150 extending between the recess 142 and the second end 132.

The clamping device 106 is defined by a base surface 156 extending between a pair of sides 158 and a first end 160 and a second end 162. The base surface 156 is in sliding relationship with the sliding surface 94 of the base 92. An inclined surface 164 is spaced from the base surface 156 a preestablished distance at the first end 160 and is spaced from the base surface 156 a preestablished distance near the second end 162. The preestablished distance near the second end 162 is greater than that at the first end 160. The second end 162 includes a vertical surface 166 extending upwardly from the base surface 156 a preestablished distance and is equal to that of the preestablished distance of the vertical surface 140 of the male forming block 100. A notch 168 is interposed the vertical surface 166 and the inclined surface 164 and extends the entire length between the pair of sides 158. The notch 168, as best shown in FIG. 5, is defined by a side wall 170 extending from the vertical surface 166 toward the first end 160 and an abutting wall 171 extending from the side wall 170 and intersecting with the inclined surface 164. In this application, with the clamping device 106 in the closed position 112 the side wall 170 is an extension of the first side wall 144 of the recess 142 and the abutting wall 171 is substantially parallel with the abutting wall 146 of the recess 142. In this application, the first force applying device 108 includes a conventional cam activated handle 172 being rotatably attached to the respective one of the pair of sides 158 of the clamping device 108.

The female forming block 124 includes a slidable mounting surface 180 being movably attached to the mounting surface 116 of the forming member 114 in a vertical direction toward and away from the sliding surface 94 of the base 92. Such an attachment, for example, could include a dove tail guided joint. Spaced from the mounting surface 180 is a concave forming surface 182. With the female forming block 124 being closest or adjacent the sliding surface 94, the female forming block 124 is in an open position 184. And, with the female forming block 124 being furthest away from the sliding surface 94, the female forming block 124 is in a closed or clamped position 186. The mounting surface 116 is defined by a pair of sides 188, a first end 190 and a second end 192. The second end 192 is positioned in contacting relationship to the sliding surface 94 of the base 92 in the open position 184 and is spaced from the sliding surface 94 of the base 92 in the closed or clamped position 186. The second end 192 includes a mating surface 194 extending from the mounting surface 182 toward the concave forming surface 182 a preestablished distance. And, an inclined surface 196 is interposed the concave forming surface 182 and the mating surface 194. The concave forming surface 182 is defined by a preestablished involute shape 198 extending between the first end 190 and the second end 192. The second force applying device 122 includes an actuating device 200, such as a cam mechanism, which when forcing the forming member 114 into the closed position simultaneously forces the female forming block 124 into the closed position 186. And, when the second force applying device 122 is moved into the open position 118 simultaneously forces the female forming block 124 into the open position 184.

Industrial Applicability

Prior to using the fixture 90, the primary surface sheet 22 has the appropriate ones of the plurality of bars 26 positioned on each side of the primary surface sheet 22 and attached thereto such as by welding. Thus in this application, each of the primary surface sheets 22 has one of the plurality of bars 26 positioned along the outer edge 34 on each side, along each of the pair of ends 36 on each side and along a portion of the base edge 30 on each side. In use the components of the donor cell 18, or the recipient cell 20, are positioned in the fixture 90, clamped into position and welded. For example, when forming the donor cell 18 the base edge 30 of the primary surface sheet 22, with the bars 26 attached, is positioned within the notch 168 and is in abutting contact with the abutting wall 171. And, the portion of the primary surface sheet 22 near the outer edge 34 is rested against the junction of the concave forming surface 182 and the first end 190 of the female forming block 124. Next, the base edge 30 of another one of the primary surface sheet 22, with the bars 26 attached, is positioned within the notch 168 and is in abutting contact with the abutting wall 171. And, the bar 26 attached to the outer edge 34 is rested against the bar 26 near the outer edge 34 of the existing primary surface sheet 22. Additionally, the pair of guide strips 24 are positioned between the primary surface sheets 22 within the wing portions 42.

With the base edge 30 of the pair of primary surface sheets 22, with the bars 26 attached, in abutting contact with the abutting wall 171 the clamping device 106 is moved from the open position 110 to the closed position 112 with the first force applying device 108. This action results in the base edge 30 being in contacting relationship with the abutting wall 171. Thus, the pair of primary surface sheets 22 and bars 26 are forced into contacting relationship one with the other forming a portion of the circumference of the inner diameter 14 of the circular recuperator 10. The next operation includes the actuation of the second force applying device 122. The actuation of the device 122 causes the forming member 114 to move axially along the sliding surface 94 of the base 92. This results in the incline surface 196 of the female forming block 124 contacting the incline surface 164 of the clamping device 106 and moves the female forming block 124 horizontally away from the sliding surface 94 of the base 92. Thus, the female forming block 124 is simultaneously moved axially toward the male forming block 100 and horizontally away from the base 92. As the female forming block 124 is moved into the closed position 186 the portion of the primary surface sheet 22 near the outer edge 34 resting against the junction of the concave forming surface 182 and the first end 190 of the female forming block 124 slidingly forces the components of the cell 12 to bend and be formed. The initial points of contact being near the outer edge 34 on one side of the cell 12 with the female forming block 124 and near the base edge 30 on the other side of the cell 12 with the male forming block 100. As the movement of the female forming block 124 continues to move into the closed position 186 the cell 12 become more and more in contacting relationship with the concave forming surface 182 on one side from the outer edge 34 of the primary surface sheet 22 to the base edge 30 of the primary surface sheet 22. And, the other side of the cell 12 becomes more and more in contacting relationship with the involute shape 150 of the forming surface 38 of the male forming block 100 from the base edge 30 of the primary surface sheet 22 to the outer edge 34 of the primary surface sheet 22. Thus, the cell 12 is uniformly bent, stretched and formed by the fixture 90.

With the cell 12 components positioned within the fixture 90, the appropriate edges 30,34,38 are welded completing the formation of the cell 12. The second force applying device 122 is disengaged and moves the female forming block 124 from the closed position 186 to the open position 184. And, the first force applying device 108 is disengaged and moves the clamping device 106 from the closed position 112 to the open position 110. The cell 12 is removed and the plurality of cells 12 are used to form the circular recuperator 10. The base edge 30 is generally perpendicular to a line tangent to a radius generated by the inner diameter 14 of the circular recuperator 10 and passing between the pair of primary surface sheets 22 forming the cell 12 at the base edge 30.

We claim:

1. A method of making a cell for use with a circular recuperator, said method of making including the steps of:

attaching a first bar to a first sheet;

attaching a second bar to a second sheet;

positioning a base edge of said first sheet in contacting relationship with an abutting wall of a first fixture;

positioning a base edge of said second sheet in contacting relationship with an abutting wall of a second fixture;

moving one of said first fixture and said second fixture into a closed position abutting said first bar and said first sheet with said second bar and said second sheet;

moving a third fixture into a closed position abutting the remainder of said first sheet with said second sheet; and securing said first sheet and said second sheet in abutting relationship.

2. The method of making a cell of claim 1 wherein said step of attaching said first bar to said first sheet includes said first bar including a plurality of first bars and one of said plurality of first bars being attached to said base edge, an additional one of said plurality of first bars being attached to an outer edge and a pair of additional ones of said plurality of first bars being attached to a pair of extension edges.

3. The method of making a cell of claim 2 wherein said step of attaching said second bar to said second sheet includes said second bar including a plurality of second bars and one of said plurality of second bars being attached to said base edge, an additional one of said plurality of second bars being attached to an outer edge and a pair of additional ones of said plurality of second bars being attached to a pair of extension edges.

4. The method of making a cell of claim 3 wherein said step of attaching said first bar to said first sheet and said step of attaching said second bar to said second sheet includes welding said first bar to said first sheet and said second bar to said second sheets.

5. The method of making a cell of claim 1 wherein said step of moving one of said first fixture and said second fixture into said closed position abutting said first bar and said first sheet with said second bar and said second sheet includes moving said first fixture axially along a sliding surface of said second fixture toward an abutting end member of said second fixture.

6. The method of making a cell of claim 1 wherein said step of moving said third fixture into said closed position abutting the remainder of said first sheet with said second sheet includes moving said third fixture axially along a sliding surface of said second fixture toward an abutting end of said second fixture.

7. The method of making a cell of claim 1 wherein said step of moving said third fixture into said closed position abutting said remainder of said first sheet with said second sheet includes moving said third fixture axially along a sliding surface of said second fixture toward an abutting end of said second fixture and horizontally moving said third fixture away from said sliding surface.

8. The method of making a cell of claim 7 wherein said step of moving said third fixture into said closed position abutting said remainder of said first sheet with said second sheet includes said axial movement and said horizontal movement being simultaneous.

* * * * *